United States Patent [19]

Schmunk

[11] 4,313,100

[45] Jan. 26, 1982

[54] FUSE TUBE WITH MILDLY TAPERED BORE

[75] Inventor: E. William Schmunk, Chicago, Ill.

[73] Assignee: S&C Electric Company, Chicago, Ill.

[21] Appl. No.: 132,922

[22] Filed: Mar. 24, 1980

[51] Int. Cl.[3] ..... H01H 85/38

[52] U.S. Cl. ..... 337/168; 337/282

[58] Field of Search ..... 337/168-181, 337/190, 281, 282, 291

[56] References Cited

U.S. PATENT DOCUMENTS

| | | | |
|---|---|---|---|
| 2,231,508 | 2/1941 | Schultz | 337/176 |
| 2,247,702 | 7/1941 | Ramsey | 337/282 |
| 2,901,573 | 8/1959 | Gesellschap | 337/169 |

*Primary Examiner*—William H. Beha, Jr.
*Attorney, Agent, or Firm*—John D. Kaufmann

[57] ABSTRACT

A single-vented fuse tube has a bore lined with an arc-extinguishing material. A movable contact moves away from a stationary contact in the bore and toward and out of an exhaust opening. An arc established between the contacts causes de-ionizing arc-extinguishing gases to evolve from the bore. The gas is exhausted from the exhaust opening. The bore is mildly tapered—to about 1° to 3° of included angle—so that its greatest diameter is at the exhaust opening. The included angle and extent of the taper are sufficient to obviate stagnation of the gases evolved deep within the bore and clogging of the bore.

10 Claims, 7 Drawing Figures

86
88
102
82
24b
24a
100
84

FUSE TUBE WITH MILDLY TAPERED BORE

BACKGROUND OF THE INVENTION

1. Field of the Invention

The present invention relates to an improved fuse tube for a cutout and, more particularly, to an improved fuse tube which exhibits improved operating performance. The improved fuse tube of the present invention may be used with a fuse link of the type described and claimed in commonly assigned co-filed United States Patent Application, Ser. No. 132,923 filed March 24, 1980 in the name of Richard J. Sabis. The fuse tube of the present invention may utilize the improved cutout described in commonly assigned, co-filed United States Patent Application, Ser. No. 132,924 filed March 24, 1980 in the name of Bruce A. Biller.

2. Discussion of the Prior Art

Single-vented fuse cutouts of various specific types are well known. A typical single-vented fuse cutout includes a hollow insulative fuse tube with a bore therethrough and conductive ferrules mounted to the opposite ends thereof. One ferrule (often called the "exhaust" ferrule) is located at an exhaust end of the bore and usually includes a trunnion casting which interfits with a trunnion pocket of a first contact assembly carried by one end of a porcelain or similar insulator. The other ferrule is normally held and latched by a second contact assembly carried by the other end of the porcelain insulator so that the fuse tube is normally parallel to, but spaced from, the porcelain insulator. The porcelain insulator is mountable to a cross-arm of a utility pole or a similar structure. A fuse link is located within the fuse tube bore with its ends respectively electrically continuous with the ferrules. One point of an electrical circuit is connected to the first contact assembly, while another point of the circuit is connected to the second contact assembly. Often, the insulator and the fuse tube are oriented generally perpendicular to the ground so that the exhaust ferrule and the first contact assembly are located below the other ferrule and the second contact assembly.

The fuse tube may include a high burst strength outer portion—for example, a fiber-glass-epoxy composite—lined with or containing an arc-extinguishing material, such as horn fiber, bone fiber, or vulcanized fiber. The arc-extinguishing material is ablative, that is, it decomposes into gaseous components when exposed to the heat of an electrical arc.

Normal currents in the electrical circuit flow without affecting the fuse link. Should a fault current or other over-current, to which the fuse link is designed to respond, occur in the circuit, the fuse link operates as described below. Operation of the fuse link permits the upper ferrule to disengage itself from the upper contact assembly, whereupon the fuse tube rotates downwardly due to coaction of the trunnion casting and the trunnion pocket. If the cutout operates properly, current in the circuit is interrupted and the downward rotation of the fuse tube gives a visual indication that the cutout has operated to protect the circuit.

Typical fuse links include a first terminal and a second terminal, between which there is normally connected a fusible element made of pure silver, silver-tin or the like. Also connected between the terminals may be a strain wire for a purpose described below. The second terminal is electrically continuous with, and is usually mechanically connected to, a button contact assembly, which is engageable by a portion of the upper ferrule on the fuse tube. The first terminal is connected to a flexible, stranded length of cable. Surrounding at least a portion of the second terminal, the fusible element, the strain wire (if used), the first terminal, and some portion of the flexible stranded cable is a sheath. The sheath is typically a cellulosic material impregnated with an ablative arc-extinguishing material (such as boric acid, magnesium borate, or the like) or may be made of an ablative arc-extinguishing material (such as horn fiber). Such ablative arc-extinguishing materials are well known and comprise compounds or compositions which, when exposed to the heat of a high-voltage arc, decompose to rapidly evolve large quantities of de-ionizing, turbulent and cooling gases. Typically, the sheath is much shorter than the fuse tube bore and terminates well short of the exhaust end thereof.

The free end of the stranded cable extends from the exhaust end of the bore and has tension or pulling force maintained thereon by a spring-loaded flipper on the trunnion casting. The tension or pulling force exerted on the cable by the flipper attempts to pull the cable and the first terminal out of the sheath and out of the fuse tube. The force of the flipper is normally restrained by the strain wire, many fusible elements not having sufficient mechanical strength to resist this tension or pulling force.

In the operation of typical cutouts, a fault current or other over-current results, first, in the melting or vaporization of the fusible element, followed by the melting or vaporization of the strain wire. Following such melting or vaporization, a high-voltage arc is established between the first and second terminals within the sheath, and the flipper is now free to pull the cable and the first terminal out of the sheath and, ultimately, out of the fuse tube. As the arc forms, the arc-extinguishing materials of the sheath decompose and high quantities of de-ionizing, turbulent and cooling gases are rapidly evolved. The movement of the first terminal under the action of the flipper, and the subsequent rapid movement thereof due to the evolved gases acting thereon as on a piston, result in elongation of the arc. The presence of the deionizing, turbulent and cooling gases, plus arc elongation, may, depending on the level of the fault current or other over-current, ultimately result in extinction of the arc and interruption of the current at a subsequent current zero. The loss of the tension on the stranded cable originally applied by the flipper permits the trunnion casting to experience some initial movement relative to the exhaust ferrule which, in turn, permits the upper ferrule to disengage itself from the upper contact assembly. This initiates the downward rotation of the fuse tube and its upper ferrule to a so-called "drop out" or "drop down" position.

As noted immediately above, arc elongation within the sheath and the action of the evolved gases may extinguish the arc. At very high fault current or over-current levels, however, arc elongation and the sheath may not, by themselves, be sufficient to achieve this end. Simply stated, at very high fault current levels, either the sheath may burst (because of the very high pressure of the evolved gas therewithin) or insufficient gas may be evolved therefrom to quench the high current level arc. For these reasons, the fuse tube is made of, or is lined with, ablative arc-extinguishing horn fiber, bone fiber or vulcanized fiber, as noted above. In the event the sheath bursts, the arc-extinguishing material of the fuse tube interacts with the arc; gas evolved as a result thereof effects arc extinction. If the sheath does not burst, the arc-extinguishing material of the fuse tube between the end of the sheath and the exhaust end of the fuse tube bore is nevertheless available for evolving gas in addition to that evolved from the sheath. The joint action of the two quantities of evolved gas, together with arc elongation, extinguishes the arc.

Typically, the fuse tube bore has a circular cross section and the portion thereof closer to the upper ferrule is just large enough to accommodate the insertion thereinto of the fuse link and, specifically, of the sheath thereof. In typical fuse cutouts, placement of the fuse link in the fuse tube bore closes the end thereof near the upper ferrule but the exhaust end of the bore remains open. As noted earlier, it is through this exhaust or open end of the bore that the cable of the fuse link extends.

Improper operation, or lack of operation, of fuse cutouts and typical fuse tubes thereof, as described above, have been detected. Specifically, at or near the maximum interrupting current rating of the above-described cutouts, improper current interruption or failure to interrupt current has been detected. An examinaion of typical cutouts and their fuse tubes, both during and after attempts at operation, has led to the conclusion that gas evolved deep in the bore—that is, remote from the exhaust end and whether evolved from the sheath or from the walls of the bore itself—often stagnates, that is, is prevented from efficiently exiting from the exhaust end of the bore due to the pressure of gas evolved from the bore in the vicinity of the exhaust end. Such stagnation may be referred to as "clogging" of the bore. More specifically, because at high interrupting current levels arcing starts deep in the bore and, indeed, within the sheath, and because at high current levels arcing often continues as the first terminal of the fuse link nears the exhaust end of the bore, the gas evolved deep within the bore is often prevented from freely exiting the exhaust end thereof due to the pressure generated by gas evolved by the wall of the bore close to the exhaust end. It has also been observed that as the first terminal of the fuse link nears the exhaust end of the bore it partially blocks the exhaust end; this partial blockage adds to the stagnation of gas evolved deep within the bore (clogging). It has been postulated that the stagnation of gas evolved deep within the bore (clogging), due to arcing before a current zero occurs, prevents recovery of sufficient dielectric strength within the bore at the current zero, thus preventing effective and permanent current interruption.

The general object of the present invention, then, is to improve the fuse tube of typical fuse cutouts to eliminate the above-described problems and to improve and render more efficient the operation thereof.

SUMMARY OF THE INVENTION

The present invention relates to an improved fuse cutout of the type which includes elongated fuse tube. The fuse tube has a central bore formed longitudinally therethrough which contains an ablative arc-extinguishing material. The bore is formed between a first closed end and a second open end of the bore. A stationary contact is located within the bore nearer the first closed end thereof. A movable contact, which is separable from the stationary contact, is movable toward the second open end through the bore. An arc established between the separating contacts decomposes the arc-extinguishing material to effect the rapid evolution of large amounts of deionizing, turbulent and cooling gases. The evolved gases function to extinguish the arc and are exhausted from the second end.

In the improved fuse cutout, the bore of the fuse tube is mildly tapered so as to have a smaller diameter closer to the first end and a greater diameter at the exhaust end. The amount of the mild taper is sufficient to prevent the stagnation of the gases within the bore (clogging) between the separating contacts.

The contacts may be elements of a fuse link which may also include a fusible element normally bridging the contacts and an arc-extinguishing sheath which surrounds the contacts and the fusible elements. Preferably, the sheath is locatable in the fuse tube bore between the closed end thereof and the inception of the taper, although it can extend beyond the taper's inception. Due to the mild taper, gases evolved from the sheath or the bore deep within the bore do not stagnate in the bore (clog) between the exhaust end and the interior thereof.

Without the mild taper, the gases evolved within the bore, either from the sheath or from the walls of the bore itself, may stagnate or be prevented from efficiently flowing out of the exhaust end by gases evolved near such exhaust end. Also, the presence of the movable contact near the exhaust end contributes to this stagnation.

The mild taper of the fuse tube bore may be either a smooth taper or a series of steps in the wall of the bore. Typically, the bore has a substantially circular cross-section and the included angle of the mild taper measured between the exhaust end and the inception of the taper is, for typical fuse tubes, from about 1° to about 3°.

Simply stated, the mild taper allows for freer exhausting of gases by (a) increasing the size of the exhaust opening from which the gases vent, (b) decreasing the concentration of gases at the exhaust opening, and (c) lessening the blocking effect of the movable contact on the exhaust opening, without (d) deleteriously affecting the mechanical strength of the fuse tube, or (e) reducing the ability of the fuse tube to evolve sufficient gases when required to do so.

Preferably, in fuse cutouts having a maximum current interrupting rating of about 10,000 amperes RMS asymmetrical with fuse tubes having suitable lengths for use at about 14.4 kv nominal, the included angle of the taper is from about 1.5° to about 2.1°. In cutouts having a maximum current interrupting rating of about 8,000 amperes RMS asymmetrical and fuse tubes having a length suitable for use at about 25 kv nominal, the included angle of the taper is from about 1.2° to about 1.7°. In fuse cutouts having a maximum current interrupting rating of about 12,000 amperes RMS asymmetrical and fuse tubes having a length suitable for use at about 25 kv nominal, the included angle of the taper is from about 1.6° to about 2.65°.

More generally, the average included angle in degrees (±about 10% to 20%) of the mild taper measured between the exhaust end and the inception of the taper may be given by $$0.175\ I + 0.05,$$

where I is the maximum current interrupting rating of the cutout in asymmetrical RMS kiloamperes. The average included angle in degrees (±about 10% to 20%) of the taper measured between the exhaust end and the inception of the taper may also be given approximately by $$(175\times10^{-5})(I^2+75\,I+173),$$

where I is the maximum current interrupting rating of the cutout in asymmetrical RMS kiloamperes. The average included angle given by these formulae vary by less than 5% over a range $6\leqq I\leqq 20$. In either case, the bore has a substantially circular cross-section and the length of the taper in inches between the exhaust end and the inception of the taper may be expressed by $$9.5-0.5\,I$$

where I is the maximum current interrupting rating of the cutout in asymmetrical RMS kiloamperes.

DETAILED DESCRIPTION

Figure 1:
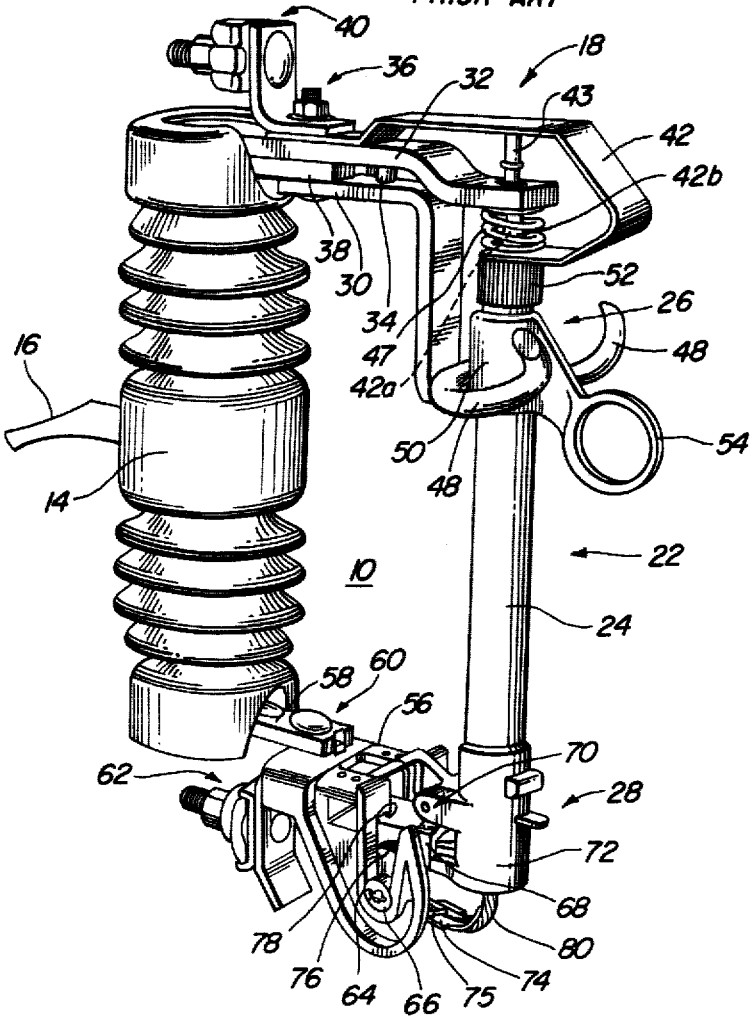
FIG 1 PRIOR ART
FIG. 1 is an elevational perspective view of a fuse cutout.

Referring first to FIG. 1, there is shown a fuse cutout 10 according to the invention of the above-noted Biller application, Ser. No. 132,924 filed March 24, 1980.

The cutout 10 includes an elongated, skirted insulator 14 which has affixed thereto a mounting member 16. The mounting member 16 permits mounting of the insulator 14 and the fuse cutout 10 to an upright or a crossarm of a utility pole (not shown). The insulator 14 may be made of porcelain or similar material.

Affixed to the upper end of the insulator 14 is an upper contact assembly generally designated 18. Affixed to the lower end of the insulator 14 is a contact assembly 20. The cutout 10 also includes a fuse tube assembly 22 which in the normal or unoperated condition of the cutout 10 may be maintained in the near vertical position shown in FIG. 1, although other orientations may be desirable. Specifically, the fuse tube assembly 22 includes an insulative fuse tube 24, which may comprise an epoxy-fiber-glass composite outer shell 24*a* lined with an ablative, arc-extinguishing material 24*b*, such as horn fiber, bone fiber, or vulcanized fiber (see FIGS. 2 or 4). Mounted or affixed to the upper end of the fuse tube 24 is an upper ferrule assembly 26, while at the opposite lower or exhaust end of the fuse tube 24 is a lower or exhaust ferrule assembly 28. In the position of the fuse tube assembly 22 depicted in FIG. 1, the lower ferrule assembly 28 is held by the lower contact assembly 20 while the upper ferrule assembly 26 is held, and latched against the movement, by the upper contact assembly 18.

The upper contact assembly 18 includes a support bar 30 bent at the 90° angle shown and an offset recoil bar 32 which runs generally parallel to a portion of the support bar 30. The bars 30 and 32 are connected together and spaced apart by a rivet or stud 34. Near the rivet or stud 34, the two bars 30 and 32 are mounted by a nut and bolt combination 36 to a mount 38, which is attached to the top of the insulator 14. Also held by the nut and bolt 36 is a connector 40, such as a parallel groove connector. The connector 40 facilitates the connection to the upper contact assembly 18 of one or more cables or conductors of a high-voltage circuit.

The upper contact assembly 18 also includes a generally J-shaped spring contact 42. The long leg of the spring contact 42 is attached as shown in FIG. 1 to the upper surface of the recoil bar 32 in the vicinity of the nut and bolt 36. The J curves out, down and back into a short leg, so that the free end of the recoil bar 32 is positioned between the legs of the contact 42. Formed in the short leg of the spring contact 42 is an indentation or concavity 42*a*. A stud or rod 43 freely passes through an aperture near the end of the recoil bar 32 and is firmly attached between the legs of the spring contact 42. Preferably, the stud or rod 43 is attached to the short leg of spring contact 42 so that its axis is coaxial with the axis of the indentation or concavity 42*a* formed in the short leg. Thus, although the spring contact 42 may flex near the nut and bolt 36, the legs (interconnected by the stud or rod 43) are constrained to move together.

Acting between the lower surface of the recoil bar 32 and the base of a convexity 42*b*, formed in the short leg of the spring contact 42 complementarily with the indentation or concavity 42*a*, is a backup spring 47 which sets a rest position for the legs of the spring contact 42.

The downwardly bent portion of the support bar 30 may have mounted thereto attachment hooks 48.

The upper ferrule assembly 26 includes a cast ferrule 50, which is attached or mounted to the upper end of the fuse tube 24. The ferrule 50 may include a threaded portion (not shown) onto which may be threaded a contact cap 52. The contact cap 52 is configured so as to fit into and be held by the indentation or concavity 42*a* formed in the short leg of the spring contact 42 when the fuse tube assembly 22 is in the position shown in FIG. 1. The ferrule 50 may also include a pull ring 54. The pull ring 54 is engageable by a hot stick or switch stick to move the upper ferrule assembly 26 away from the upper contact assembly 18 while the lower ferrule assembly 28 rotates in the lower contact assembly 20, as described below. In view of the nature of high-voltage circuits, this opening movement of the fuse tube assembly 22 must be effected while the circuit connected to the cutout 10 is de-energized or else an arc will form between the upper ferrule assembly 26 and the upper contact assembly 18. The fuse tube assembly 22 may also be opened by initially attaching between the attachment hooks 48 and the pull ring 54 a portable load-break tool. Such a portable load-break tool permits the fuse tube assembly 22 to be opened with the circuit energized, momentarily having transferred thereto the flow of current in the circuit 10 and interrupting such current internally thereof.

The lower contact assembly 20 includes a support member 56 attached to a mount 58 by a nut and bolt combination 60. The support member 56 may also carry a connector 62, such as a parallel groove connector. The connector 62 facilitates the connection to the lower contact assembly 20 of an additional cable(s) or conductor(s) of the high-voltage circuit in which the fuse cutout 10 is to be used. It should be noted that the connectors 40 and 62 may both take the form of that described and claimed in commonly assigned United States Patent Application, Ser. No. 218,867, filed Dec. 22, 1980 as a continuation of Ser. No. 60,947, filed July 26, 1979 in the name of Hiram Jackson.

Formed in the support member 56 are trunnion pockets 64. The trunnion pockets 64 are designed to hold outwardly extending portions 66 of a trunnion casting 68 which is pivotally mounted at a toggle joint 70 to a cast ferrule 72 which is attached or mounted to the lower or exhaust end of the fuse tube 24. As hereinafter described, the trunnion casting 68 and the cast ferrule 72 are normally rigidly held in the relative position depicted in FIG. 1. In this normal relative position of the trunnion casting 68 and the ferrule 72, the contact cap 52 may be engaged by and held in the concavity 42*a* formed in the short leg of the spring contact 42 to maintain the fuse tube assembly 22 in the position depicted in FIG. 1. Also, as described in more detail below, when a fuse link within the fuse tube 24 operates, the trunnion casting 68 and the ferrule 72 are no longer so rigidly held, and the ferrule 72 may rotate downwardly relative to the trunnion casting 68 about the toggle joint 70. This movement of the ferrule 72 permits the contact cap 52 to disengage the spring contact 42, following which the entire fuse tube assembly 22 rotates about the lower contact assembly 20 via rotation of the extending portions 66 in the trunnion pockets 64.

Rotatably mounted to the trunnion casting 68 is a flipper 74. A spring 75 mounted between the trunnion casting 68 and the flipper 74 biases the flipper 74 away from the lower or exhaust end of the fuse tube 24.

The trunnion casting 68 includes shoulders 76 or other features. The support member 56 also includes features, such as shoulders 78, normally spaced from the shoulders 76 when the extending portions 66 of the trunnion casting 68 are seated in their respective trunnion pockets 64. The normal spacing between the shoulders 76 and 78 is about equal to the normal spacing between the top of the convexity 42*b* and the recoil bar 32.

To use the fuse cutout 10, the fuse tube assembly 22 is first "armed" with a fuse link. Suffice it here to say that the contact cap 52 is removed and the fuse link is inserted into the interior of the fuse tube 24 from the upper end thereof. A portion of the fuse link abuts a shoulder (not shown) at the top of the ferrule 50, following which the contact cap 52 is threaded back onto the ferrule 50. A flexible stranded cable 80 forming a part of the fuse link exits an exhaust opening in the lower or exhaust end of the fuse tube 24. The flipper 74 is manually rotated against the action of the spring 75 to position it adjacent the exhaust opening, following which the cable 80 is laid into a channel formed in the flipper 74. The cable 80 is then wrapped around a flanged nut (not shown) which is threaded onto a stud (not shown) on the trunnion casting 68. Following tightening of the flanged nut to hold the cable 80, the flipper 74 is maintained against the bias of the spring 75 in the position shown in FIG. 1, whereat there is a constant tension force applied to the cable 80 and, accordingly, to the fuse link within the fuse tube 24. It in this connection of the cable 80 to the trunnion casting 68 by the flanged bolt and the action of the spring 75 on the flipper 74 which normally holds the trunnion casting 68 and the ferrule 72 in the position depicted in FIG. 1 relative to the toggle joint 70.

Following operation of a fuse link within the fuse tube 24, the flipper 74 is able to move the cable 80 downwardly within the fuse tube 24. The release of the tension force applied to the cable 80 by the flipper 74 permits relative movement of the ferrule 72 and the trunnion casting 68 about the toggle joint 70 to permit separation of the contact cap 52 from the spring contact 42.

The relative movement of the ferrule 72 and the trunnion casting 68 occurs after tension in the cable 80 is released and after an initial upward thrust of the fuse tube 24 subsides. As set forth more fully in the above-noted application of Sabis, Ser. No. 132,923 filed Mar. 24, 1980, when a fusible element of the fuse link within the fuse tube 24 melts, there follows the rapid evolution of arc-extinguishing gas within the fuse tube 24. The evolved gas exits the exhaust opening of the fuse tube 24 at a very rapid rate, thrusting the fuse tube 24 upwardly in jet-like fashion. Before the cutout 10 is closed—i.e., before the fuse tube assembly 22 is rotated, by rotating the extensions 66 of the trunnion casting 68 in the trunnion pockets 64 of the support member 56, until the contact cap 52 engages the concavity 42*a*—the spring 47 and the long leg of the contact 42 set a rest position for the legs of such contact 42. In this rest position, the convexity 42*b* is spaced from the recoil bar 32. After the cutout 10 is closed, the contact cap 52 deflects the short leg of the J 42 (and also flexes the long leg) upwardly against the spring bias of the spring 47 and of the long leg to decrease the spacing between the convexity 42*b* and the recoil bar 32 to that of the spacing between the shoulders 76 and 78. This situation obtains until the fuse link within the fuse tube 24 operates in response to a fault current or other over-current.

When the fuse link operates, the tension on the cable 80 is released at the same time the fuse tube 24 thrusts up. The relative movement of the ferrule 72 and the trunnion casting 68 about the toggle joint 70 does not immediately occur—though it is able to occur because of the release of tension in the cable 80—due to the thrust of the fuse tube 24. This thrust, therefore, results in simultaneous engagement of the shoulders 76 and 78 at one end of the fuse tube 24 and of the convexity 42*b* and the recoil bar 32 at the other end of the fuse tube 24. These simultaneous engagements transfer the thrust forces on the fuse tube assembly 22 more or less equally to the contact assemblies 18 and 20 until the thrust subsides. As the thrust subsides and the fuse tube assembly 22 begins to move back down under the action of the spring 47 and the long leg of the J 42, (1) the shoulders 76 and 78, and the convexity 42*b* and the recoil bar 32 separate, and (2) the aforedescribed relative movement of the ferrule 72 and the trunnion casting 68 occurs. This relative movement permits the contact cap 52 to disengage the concavity 42*a* and the fuse tube assembly 22 to rotate to the "drop out" position via rotation of the extensions 66 in the trunnion pockets 64. All of the above is "timed" so that rotation of the assembly 22 is initiated as or after the fuse cutout interrupts current in the circuit.

Figure 2:
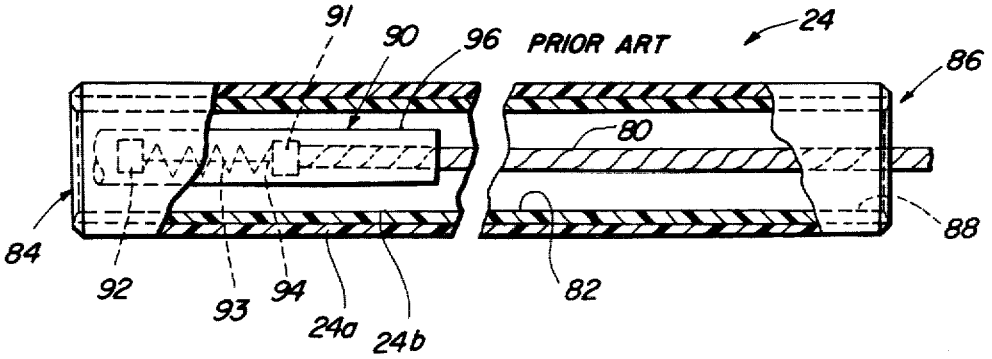
FIG 2 PRIOR ART
FIG. 2 is an elevational partially-sectioned view of a fuse tube according to the prior art which is usable with the fuse cutout of FIG. 1.

Referring now to FIG. 2, there is shown in greater detail a partially-sectioned view of the fuse tube 24 according to the prior art. The fuse tube 24, as noted previously, includes the outer shell 24*a*, which may comprise an epoxy-fiber-glass composite, and the inner shell 24*b*, which may comprise an arc-extinguishing material such as bone fiber, horn fiber or vulcanized fiber. The fuse tube 24 has a bore 82, the walls of which constitute the arc-extinguishing inner shell 24*b*. The fuse tube 24 has two ends labeled 84 and 86, respectively. The upper ferrule assembly 26 is mounted to the end 84, while the lower or exhaust ferrule assembly 28 is mounted to the end 86. The bore 82 terminates in an exhaust opening 88 at the end 86. As noted previously, the bore 82 is typically closed at the end 84 by the insertion into the bore 82 of the fuse link and by the threading of the contact cap 52 onto the ferrule 50. In prior art fuse tubes 24, the bore 82 has a generally circular cross-section of a substantially uniform diameter over the length of the tube 24.

A fuse link 90, only a portion of which is schematically shown in FIG. 2, is typically used with the fuse tube 24 in the following manner. The fuse link 90 includes a first movable terminal 91 and a second stationary terminal 92. The terminals 91 and 92 are normally bridged by a fusible element 93, which may be made of silver, silver-tin or the like. Also bridging the terminals 91 and 92 may be a strain wire 94. Connected to the movable terminal 91 is the cable 80. Surrounding the terminals 91 and 92, the fusible element 93, strain wire 94, and some portion of the cable 80 is an arc-extinguishing sheath 96 which may be made of or include an ablative, arc-extinguishing material, such as bone fiber, horn fiber, vulcanized fiber, boric acid-impregnated cellulose, or magnesium borate-impregnated cellulose.

In arming the fuse tube 24 with the fuse link 90, the fuse link 90 is placed within the bore 82, as shown in FIG. 2. The terminal 92 is held stationary by facilities (not shown) associated with the upper end 84 of the fuse tube 24 and the upper ferrule 50. The fuse link 90 is so positioned within the bore 82 that the cable 80 extends out of the exhaust opening 88 at the end 86 of the fuse tube 24 and is ultimately attached to the trunnion casting 68, as described above, for holding the flipper 74 in the position shown in FIG. 1.

During normal circuit conditions, current flows into one of the connectors, say the connector 40, and then through the following path: the upper contact assembly 18, the contact cap 52, the second terminal 92, the fusible element 93, the movable terminal 91, the cable 80, the trunnion casting 68, the lower contact assembly 20, and the connector 62. Should a fault current or other over-current occur to which the fusible element 93 is designed to respond, the effect ($I^2t$) of such current first melts, fuses or vaporizes the fusible element 93, following which the strain wire 94 is similarly melted, fused, or vaporized. As the fusible element 93 and the strain wire 94 become disintegral, the flipper 74 and the spring 75 begin to pull the cable 80 out of the exhaust opening 88 and the movable terminal 91 moves toward the end of the fuse tube 86. Simultaneously therewith, an arc is established between the terminals 91 and 92. This arc interacts with the arc-extinguishing material of the sheath 96 generating, as described above, large quantities of arc-extinguishing gas. At some point in time, the pressure of the evolved gas acting on the movable terminal 91 in piston-like fashion becomes greater than the force exerted on the terminal 91 by the flipper 74 and begins to even more rapidly expel the terminal 91 out of the sheath 96. Ultimately, the terminal 91 exits the sheath 96. Should the initial arc established between the contacts 91 and 92 not have been extinguished at this point for any reason, the arc persists and now interacts with the arc-extinguishing material **24*b* of the bore 82. This interaction evolves additional arc-extinguishing gas from the arc-extinguishing material 24*b* as the terminal 91 continues to move toward the exhaust opening 88. Ideally, near or before the time the movable contact 91 reaches the exhaust opening 88, are elongation, due to movement of the contact 91, and the action of the arc-extinguishing gases, evolved from both the sheath 96 and the bore 82, result in permanent extinction of the arc at a current zero. This movement of the terminal 91 and the cable 80 effects the previously described release of tension on the cable 80 which is ultimately followed by movement of the fuse tube assembly 22** to the "drop out" position.

It should be noted that the arc-extinguishing gases are evolved in at least two separate portions of the fuse tube 24. First, at the inception of the arcing, arc-extinguishing gases are evolved from the sheath 96 "deep" within the bore 92, that is, closer to the end 84 of the fuse tube 24. Arc-extinguishing gases are also evolved from the arc-extinguishing material **24*b* "deep" within the bore 92, whether the sheath 96 bursts or if the sheath 96 remains integral, just after the terminal 91 exits the sheath 96. Second, arcing may also evolve gases from the arc-extinguishing material 24*b* near the end 86 of the fuse tube 24 in the vicinity of the exhaust opening 88. Studies of cutouts during and after operation indicate that the amount of gas generated in the vicinity of the exhaust opening 88 can generate substantial high pressures within the bore 82, especially when the fault current which the cutout 10 is attempting to interrupt is at or near the maximum interrupting current rating thereof. These high pressures influence both the pressure at the exhaust opening 88 and upstream thereof, i.e., at or near the deep portions of the bore 82**.

Figure 3:
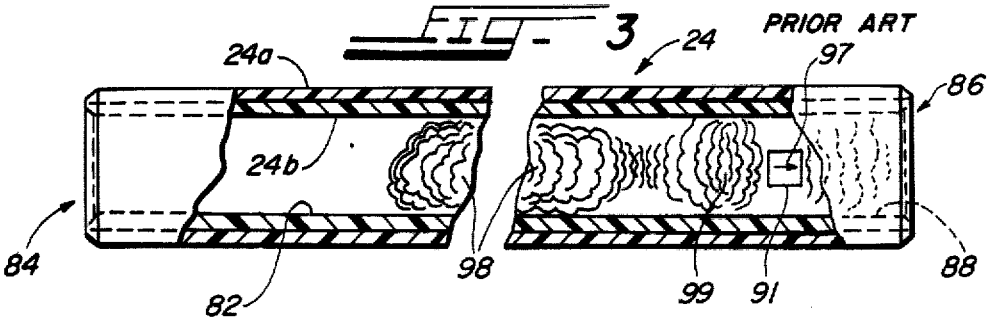
FIG. 3 is a view similar to FIG. 2 showing the prior art fuse tube during the operation of the cutout and illustrating operational problems inherent therein.

Turning now to FIG. 3, operational problems experienced with fuse tube 24 of the prior art are diagrammatically illustrated. The only portion of the fuse link 90 depicted in FIG. 3 is the movable terminal 91. As shown by the arrow 97, the terminal 91 is, at the time depicted in FIG. 3, still moving toward exhaust opening 88. Further, arcing between the terminal 91 and the stationary terminal 92 is still continuing or has only momentarily ceased due to the reaching of a current zero. A quantity of gas, schematically represented at 98, is being evolved deep within the bore 82, both due to the action of the sheath 96 and of the arc-extinguishing material **24*b* closer to the end 84 of the fuse tube 24. The arcing, which has continued until the terminal 91 reaches the position shown, also generates arc-extinguishing gas in the vicinity of the exhaust opening 88, as schematically represented by a quantity of gas 99. Pressure generated by the gas 99 tends to resist the efforts of the gas 98 to reach and exit from the exhaust opening 88. Thus, the generation of the gas 99 may cause the stagnation of the gas 98, and the clogging of the bore 82, and prevent efficient flow of the gas 98 out of the exhaust opening 88. Further, as the contact 91 nears the exhaust opening 88, it tends to block such opening, further adding to the stagnation of the gas 98 and the clogging of the bore 82. The stagnation of the gas 98 has been observed to prevent rapid recovery of sufficient dielectric strength between the contact 91 and the stationary contact 92 so that at a current zero, which occurs when the terminal 91 is roughly at the position shown in FIG. 3, interruption or permanent extinction of the arc may not occur. That is, should there be insufficient dielectric strength between the contacts 91 and 92 at the current zero caused by the stagnation of the gas 98**, arcing may become reestablished and interruption not effected.

Turning now to FIG. 4, fuse tubes 100 according to the present invention are depicted. Portions of the fuse tubes 100 which are similar to or the same as the fuse tube 24 depicted in FIG. 3 have the same or similar reference numerals appended thereto.

Essentially, the fuse tubes 100 include the outer and inner shells 24*a* and 24*b* constituted similarly to those of the fuse tube 24. Fuse tube 100 also includes the bore 82 and the ends 84 and 86, situated similarly to their corresponding elements in FIG. 3. The bore 82 is, however, mildly tapered as generally shown at 102 in the vicinity of the exhaust opening 88. The taper 102 is a mild taper and may comprise the cylindrical step-like transitions shown or may be a smooth taper (not shown). For fuse tubes 100 which are to be used with cutouts 10 having common current and voltage ratings, a mold taper having an included angle of about 1° to about 3° has been found effective. Notwithstanding the high pressures generated within the fuse tubes 100 following operation of the fuse link 96, it has been unexpectedly found that the mild taper 102 is sufficient to prevent stagnation of the gases 98 and clogging of the bore 82. Specifically, with the mild taper 102, it has been found that the gases 99 evolved near the exhaust opening 88 and the partial blockage of the exhaust opening 88 effected by the terminal 91 do not stagnate the gases 98 which were evolved deep within the bore 82 and permit the efficient exit of the gases 98 from the exhaust opening 88. Thus, the mild taper 102 has been observed to permit the bore 82 to recover sufficient dielectric strength between the terminals 91 and 92 so that faults at or near the maximum current interrupting current rating of the fuse tube 100 are interrupted at an early current zero.

Figures 4A, 4B, 4C:
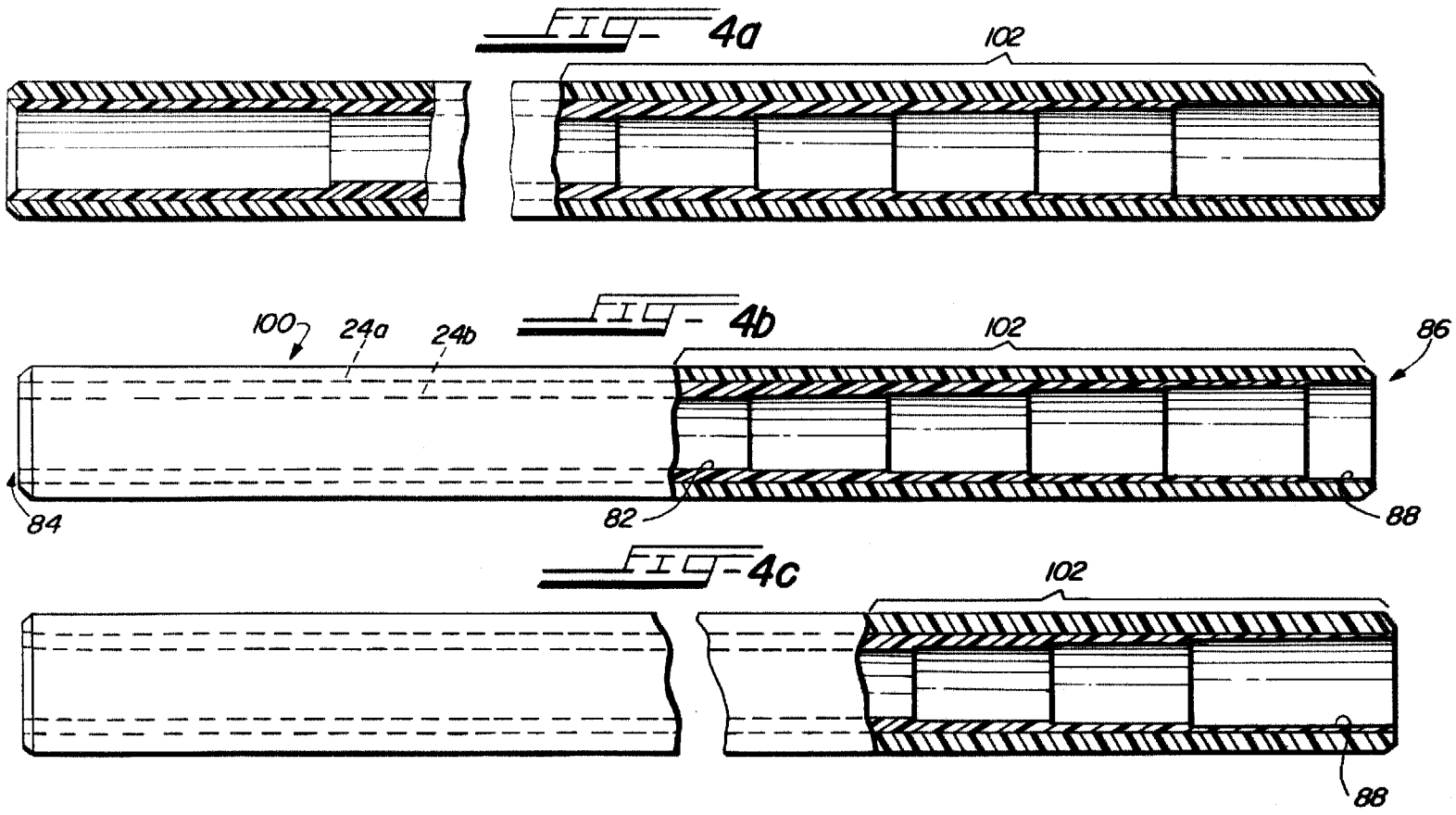
FIG. 4*a*–4*c* are fuse tubes according to the present invention usable with the fuse cutout of FIG. 1 for improving the operation thereof.

As specific examples, the fuse tube 100 depicted in FIG. 4*a* is used in a cutout 10 having a nominal 25 kv voltage rating and an 8,000 RMS asymmetrical ampere maximum current interrupting rating. In the fuse tube of FIG. 4*a*, the mild taper 102 comprises five stepped portions which decrease in diameter from 0.656 inches at the exhaust opening 88 to 0.531 inches at the last stepped portion before the main portion of the bore 82 begins. The bore 82 itself has a diameter of 0.500 inches. In the fuse tube 100 of FIG. 4*a*, the length of the mild taper 102 from its inception at the bore 82 to the exhaust opening 88 is approximately 5½ inches.

The fuse tube 100 of FIG. 4*b* is used in a cutout having a nominal 14.4 kv voltage rating and a 10,000 RMS asymmetrical ampere maximum current interrupting rating. Again, the diameter of the bore 82 is 0.500 inches and the five steps comprising the mild taper 102 increase from 0.531 inches at the inception thereof to 0.656 inches at the exhaust opening 88. The extent of the mild tapered section 102 is 4½ inches.

The fuse tube 100 in FIG. 4*c* is used in a cutout having a nominal 25 kv voltage rating and a 12,000 RMS asymmetrical ampere maximum current interrupting rating. The three steps of the mild tapered section 102 increase from 0.552 inches at the inception thereof to 0.656 inches at the exhaust opening 88. The length of the mild tapered section 102 is 3½ inches. The bore 82, again, has a diameter of 0.500 inches.

Figure 5:
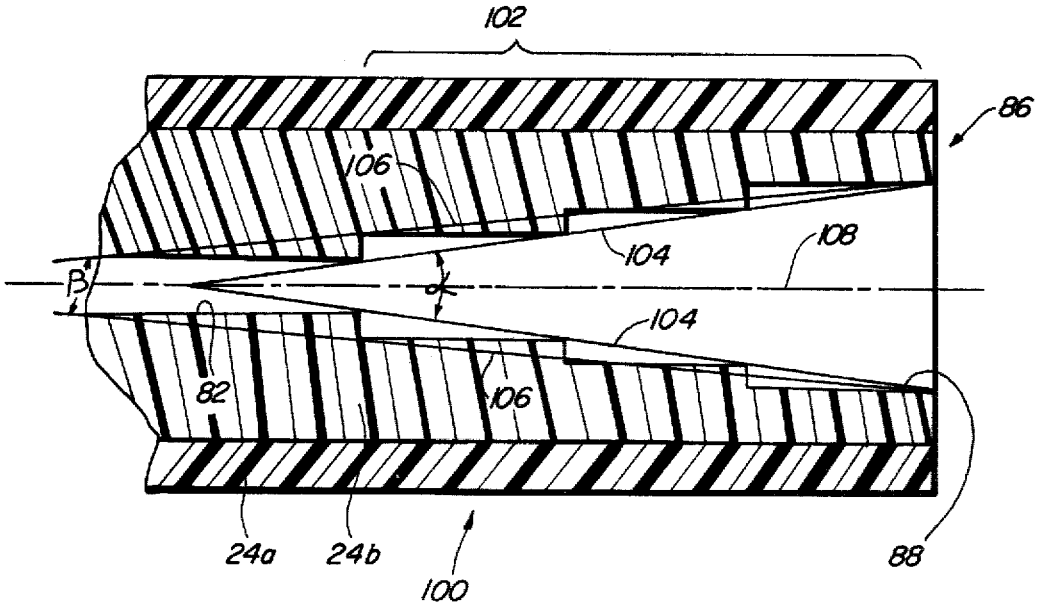
FIG. 5 is an enlarged view of a portion of the improved fuse tubes of FIG. 4 which illustrates in greater detail the novel features thereof.

Turning now to FIG. 5, there is shown a greatly magnified view of the mild taper 102 of any fuse tube 100 depicted in FIGS. 4*a*–4*c*. Although only three steps are shown in FIG. 5, it should be understood that any number of steps, as well as a smooth taper, could be utilized. The proportions depicted in FIG. 5 have been greatly exaggerated for illustrative purposes only.

Generally, the amount of the mild taper may be illustrated by one of two types of imaginary lines 104 and 106 coaxial with a central axis 108 of the bore 82 and drawn between the exhaust opening 88 and the inception of the taper 102. Specifically, the lines 104 are drawn from the exhaust opening 88 to the innermost portion of the first step, while the lines 106 are drawn from the exhaust opening 88 to the outermost portion of the first step. Whether the mild taper 102 is viewed as defined by the lines 104, the lines 106, or some intermediate lines, it has been found that if the angle included between matching pairs of lines 104-104 or 106-106 is between about 1° and 3°, improvement in operation in the fuse tube 100, as described above, is achieved. If the mild taper 102 is smooth rather than stepped, the lines 104 or 106 may be viewed as defining the walls of the bore 82. For the fuse tube 100 depicted in FIG. 4*a*, the angle included between the lines 104 is about 1.63°, the angle included between the lines 106 is about 1.3°, and the average is about 1.45°. For the fuse tube 100 depicted in FIG. 4*b*, the angle included between the lines 104 is about 2.0°, while the angle between the lines 106 is about 1.6°. The average of these last two angles is about 1.8°. For the fuse tube depicted in FIG. 4*c*, the angle included between the lines 104 is about 2.5° and the angle included between the lines 106 is about 1.7° with the average being about 2.1°.

Using the average included angles, as described immediately above, and assuming that the included angle of the mild taper 102 is linearly dependent upon the maximum current interrupting rating of the cutout 10 in which the fuse tube 100 is used, it can be shown that the included angle of the taper 102 is approximately given by $$0.175\ I + 0.05,$$

where I is the maximum current interrupting rating of the fuse tube 100 in RMS asymmetrical kilomaperes. The included angle of the mild taper 102 can also be shown to be approximately defined by the quadratic equation $$(175 \times 10^{-5})\ (I^2 + 75\ I + 173),$$

where I is the maximum current interrupting rating of the fuse tube 100 in RMS asymmetrical kiloamperes. Further, the length of the tapered section 102 within reasonable limits can be shown to be approximately given by $$9.5 - 0.5\ I,$$

where I is the maximum current interrupting rating of the fuse tube 100 in RMS asymmetrical kiloamperes.

Applicant is aware of the fact that many expulsion power fuses contain a taper or a counter-bore at the exhaust end of their fuse holders, the counter-boring being formed within a body of arc-extinguishing material at such exhaust end. It should be noted, however, that the construction and operation of such power fuses is, for purposes of this invention, essentially different from the operation of the fuse cutout 10 in the following respects. First, in such power fuses, a movable contact or arcing rod moves away from the exhaust end of a fuse holder and deeper into the bore during operation of the fuse. In the cutout of the present invention, the movable contact 91 moves toward the exhaust end 88 and out of the deep portion of the bore 82 during operation thereof. Second, in the power fuses of the prior art, the movable contact or arcing rod moves in a direction opposite that taken by evolved arc-extinguishing gases as they exit the exhaust end of the fuse holder. In the cutout 10 of the present invention, the movable contact 91 moves in the same direction as the arc-extinguishing gas exiting from the exhaust opening 88. Third, the tapering or counter-boring in prior art power fuses is typically on the order of 15° of included angle. In contradistinction, the mild tapering 102 of the fuse tube 10, as set forth above, is in the range of about 1°–3°.

The above-described embodiments of the present invention are simply illustrative of the principles thereof. Various other modifications and changes may be devised by those skilled in the art which embody the principles of this invention, yet fall within the spirit and scope thereof.

I claim:

1. An improved fuse cutout of the type including an elongated fuse tube with an ablative-arc-extinguishing-material-containing central bore formed longitudinally therethrough between a first closed end and a second open end of the bore, a stationary contact nearer the first end within the bore, and a movable contact separable from the stationary contact and movable toward the second end through the bore; an arc established between the separating contacts decomposing the arc-extinguishing material to effect the rapid evolution therefrom of large amounts of de-ionizing, cooling and turbulent gases, which are exhausted from the second end, for extinguishing the arc; wherein the improvement comprises:

the bore being mildly tapered so as to have a smaller diameter closer to the first end and a greater diameter at the second end, the included angle of the mild taper measured between the exhaust end and the inception of taper being from about 1° to about 3°, the included angle and length of the mild taper being sufficient to obviate both stagnation of the gases within the bore between the separating contacts and clogging of the bore.

2. An improved fuse cutout as in claim 1, being of the type usable with a fuse link having as elements the contacts, a fusible element normally bridging the contacts, and an arc-extinguishing sheath surrounding the contacts and the fusible element, wherein the improvement further comprises:

the sheath being locatable in the fuse tube bore generally between the closed end thereof and the second, open end so that gases evolved from the sheath and the bore do not stagnate within the bore between the open end thereof and the end of the sheath closest thereto and do not clog the bore.

3. An improved fuse cutout of the type including an elongated fuse tube with an ablative-arc-extinguishing-material-containing central bore formed longitudinally therethrough between a closed first and an open second exhaust end of the bore; a stationary contact in and nearer the first end of the bore; and a movable contact separable from the stationary contact and movable in the bore toward the exhaust end; an arc being established between the separating contacts deep in the bore and remote from the exhaust end, the arc decomposing the arc-extinguishing material along the bore to effect the rapid evolution therefrom of large amounts of de-ionizing, cooling, turbulent gases for extinguishing the arc, which gases are exhausted from the exhaust end, gases evolved near the exhaust end and the presence of the movable contact near the exhaust end causing both stagnation in the bore of the gases evolved deep in the bore and clogging of the bore; wherein the improvement comprises:

the bore being mildly tapered so as to have a smaller diameter closer to the closed end and a greater diameter at the exhaust end, the included angle of the mild taper measured between the exhaust end and the inception of the taper being from about 1° to about 3°, the included angle and length of the mild taper being sufficient to obviate both the stagnation of the gases deep in the bore and the clogging of the bore.

4. An improved fuse cutout as in claim 3, being of the type usable with a fuse link having as elements the contacts, a fusible element normally bridging the contacts, and an arc-extinguishing sheath surrounding the contacts and the fusible element; wherein the improvement further comprises:

the sheath being locatable in the fuse tube bore generally between the closed end thereof and the second, open end so that the gases evolved from the sheath and the bore do not stagnate within the bore between the open end thereof and the end of the sheath closest thereto and do not clog the bore.

5. An improved fuse cutout as in claim 1, 2, 3 or 4, wherein: the mild taper is a smooth taper in the wall of the bore.

6. An improved fuse cutout as in claim 1, 2, 3 or 4, wherein: the mild taper comprises a series of steps in the wall of the bore.

7. An improved fuse cutout as in claim 1, 2, 3 or 4, wherein:

The included angle of the mild taper is from about 1.2° to about 2.65°.

8. An improved fuse cutout as in claim 7, the cutout having a maximum current interrupting rating of about 10,000 amperes RMS asymmetrical and the fuse tube having a length suitable for use at about 14.4 kv nominal, wherein:

the included angle of the mild taper is from about 1.5° to about 2.1°.

9. An improved fuse cutout as in claim 7, the cutout having a maximum current interrupting rating of about 8,000 amperes RMS asymmetrical and the fuse tube having a length suitable for use at about 25 kv nominal, wherein:

the included angle of mild taper is from about 1.2° to about 1.7°.

10. An improved fuse cutout as in claim 7, the cutout having a maximum current interrupting rating of about 12,000 amperes RMS asymmetrical and the fuse tube having a length suitable for use at about 25 kv nominal, wherein:

the included angle of the mild taper is from about 1.6° to about 2.65°.

* * * * *